United States Patent [19]

Eshelman

[11] 3,947,138

[45] Mar. 30, 1976

[54] PAPER PAD CLAMPING FIXTURE

[75] Inventor: Raymond H. Eshelman, St. Petersburg, Fla.

[73] Assignee: Oravisual Company, Inc., St. Petersburg, Fla.

[22] Filed: Nov. 27, 1974

[21] Appl. No.: 527,765

[52] U.S. Cl. ..... 402/69; 402/60; 24/67.3; 24/248 PC

[51] Int. Cl.[2] ..... B42F 1/00

[58] Field of Search ..... 24/243 P, 248 PC, 67.1, 24/67.3, 67.5, 154; 225/27, 28; 402/68, 60, 69; 282/29 B

[56] References Cited

UNITED STATES PATENTS

| | | | |
|---|---|---|---|
| 776,247 | 11/1904 | Krone | 402/68 |
| 1,668,912 | 5/1928 | Keays et al. | 24/67.5 |
| 2,985,174 | 5/1961 | Guth | 24/67.1 |
| 3,105,495 | 10/1963 | Heyer | 24/67.3 |
| 3,312,513 | 4/1967 | Barker | 402/68 |

*Primary Examiner*—Bernard A. Gelak
*Attorney, Agent, or Firm*—Edwin E. Greigg

[57] ABSTRACT

A clamping fixture detachably mountable on an easel, or wall, mounted upright, support board hanging a heavy stack of large paper sheets against the front face of the support board so that the stack may be readily removed or rearranged, or the sheets torn off one-by-one. The fixture comprises a back support member, a top clamp housing member, and a blade member. The blade member and the clamp housing are pivotally connected to each other so as to move in unison when the clamp housing is pivoted about the back support member for inserting or removing a stack of papers. The blade member also acts as a clamping member and is tensioned for automatically adapting to the thickness of the sheets or pads of paper and means are provided for quickly and automatically permitting the fixture to open and then snap lock automatically in closed position, making the insertion and removal of display sheets or pads an effortless task.

10 Claims, 9 Drawing Figures

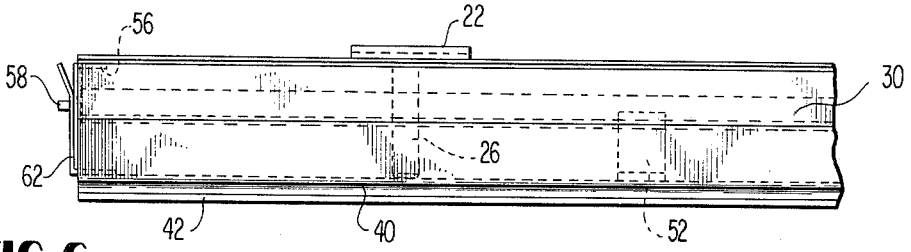
FIG. 6
FIG. 7
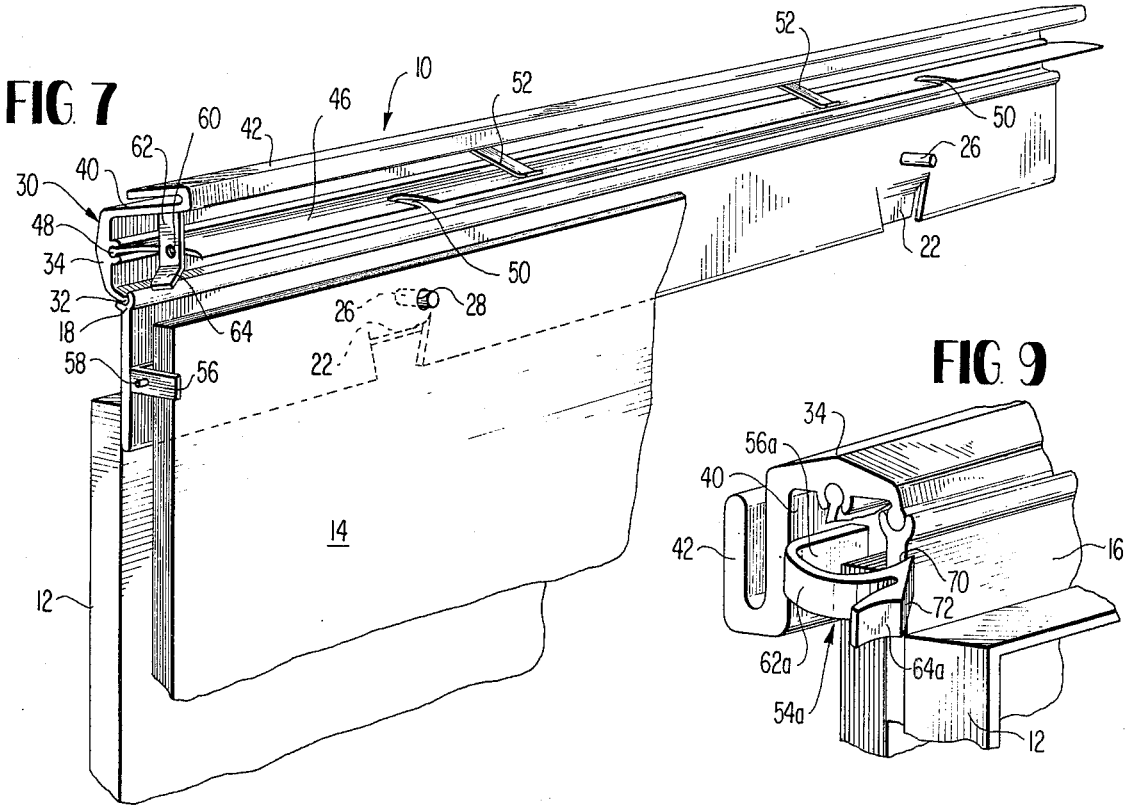
FIG. 9
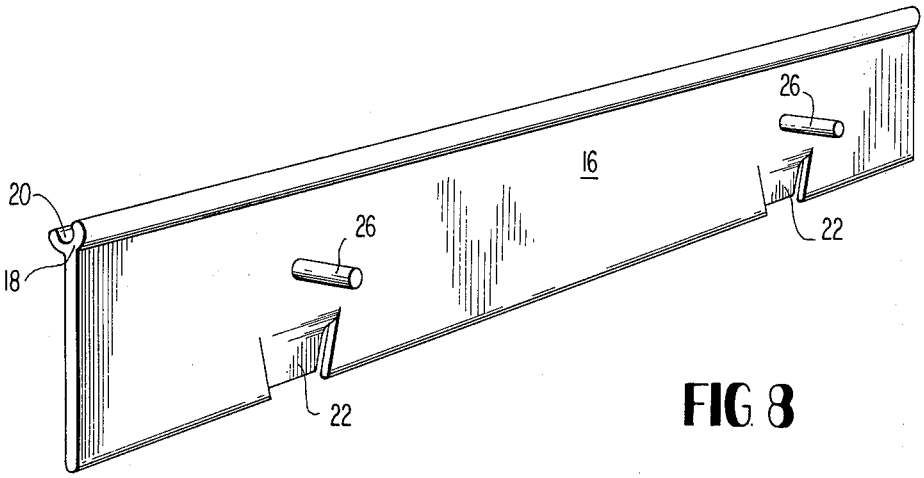
FIG. 8

PAPER PAD CLAMPING FIXTURE

BACKGROUND OF THE INVENTION

1. Field of Invention

This invention relates to fixtures for hanging stacks of large sheets of paper on the surface of an upright support board on a lecture or display stand; such display stands being disclosed and claimed in U.S. Patent 2,638,300 owned by the assignee of the present application.

2. Prior Art

Clamping fixtures for holding and gripping pads of tearable paper detachably held on a lecture or display stand are typically described and claimed in the U.S. Pat. No. 2,985,174, issued to Chester K. Guth on May 23, 1961. In the patent the clamping fixture comprises an inverted channel-shaped top casing member which was attached to the support board and provided in its internal channel space with a pivoted knife member which served to not only form the tear blade, but also clamp the pad in position. In this fixture, the tear blade had a spur or flange plate which was engaged by thrust applying screws outside the channel space to provide the clamping action. Thus, to insert and hold the paper on the support board not only required insertion into the clamping fixture channel space but further also required actuation of the thrust engaging screws so as to cause the tear blade to engage the paper. The required actuation of the engaging screws made it difficult to reinsert or rearrange the pads of paper during a lecture, for exmple, even though the fixture did function to hold the pad and to permit sheets to be torn off one-by-one.

Thus, in view of the prior art, it is an object of this invention to hold and support pads or single sheets of display paper so that they can be readily removed or rearranged from the fixture while on the lecture or display stand.

Another object of this invention is to allow the improved fixture to open and then snap lock automatically in a closed position, thereby making the insertion and removal of the display sheets or pads an effortless task.

An additional object of this invention is to greatly improve manufacturing efficiency by the elimination of many parts of the clamping fixture of the prior art.

SUMMARY OF THE INVENTION

The foregoing objects are realized in the present invention which comprises principally three relatively long members preferably of extruded lengths of metal — a back support member, a top channel shaped clamp housing, and a tear member. The tear member is pivotally hinged to the clamp housing within the channel space of the clamp housing and the clamp housing is, in turn, pivotally mounted on the back support member so that pivoting the clamp housing automatically carries with it the tear member so as to open the fixture for the ready insertion or removal of a sheet or pad of paper. The tear member is biased so as to engage the sheet or pad of paper automatically regardless of the difference in thickness of the sheet or pad and means are also provided to permit the fixture to be opened and then automatically snap locked in closed position thereby making the insertion or removal of the display sheets or pads an effortless task.

BRIEF DESCRIPTION OF THE DRAWINGS

The accomplishment of the objects of the invention will become apparent from the following description of the preferred embodiment wherein:

FIG. 6 is a top or plan view of the clamping fixture as shown in FIG. 2;

FIG. 7 is a perspective view showing the fixture in open position showing the paper supported by protruding studs fastened to the back support member;

FIG. 8 is a perspective view of the back support member; and

FIG. 9 is a fragmentary perspective view of the rear of the structure, like FIG. 3, but showing an alternative form of snap lock arrangement.

DETAILED DESCRIPTION

Figure 1:
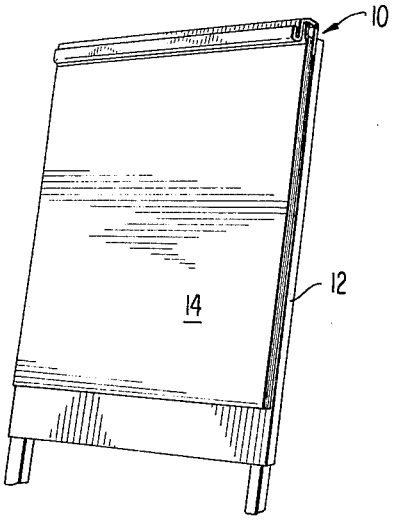
FIG. 1 is a perspective view of the clamping fixture mounted detachably on the top edge of an easel supported paper-backing or support board with a pad of paper display sheets suspended on the front face thereof.
Figure 2:
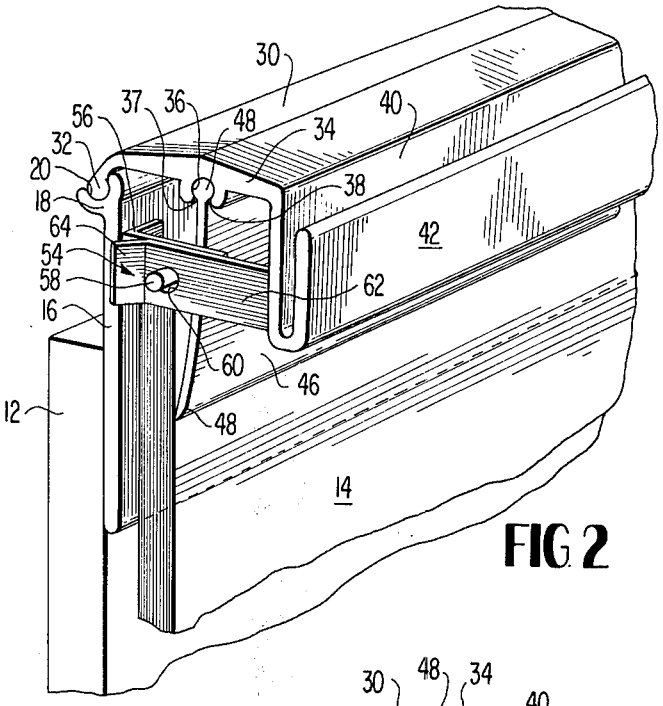
FIG. 2 is an enlarged perspective view of the clamping fixture embodying the present invention showing only the top margin of the support board and of the stack or pad of paper sheets backed thereby.

Turning now to the drawings, particularly FIGS. 1 and 2, it can be seen that the clamping fixture comprising the present invention is indicated in its entirety as 10 and is shown connected to the highest or top edge of an easel-type support board 12 for clamping and holding sheets or pads of paper 14. The back support 12 is supported, in this embodiment, on an easel such as shown and claimed in the U.S. Patent to DeJen, U.S. Pat. No. 2,638,300 which was issued May 12, 1953.

Figure 3:
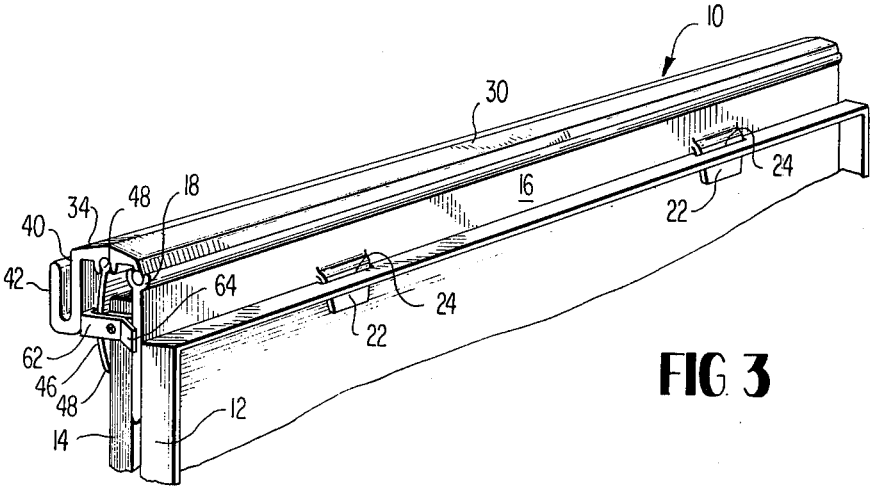
FIG. 3 is a fragmentary perspective view of the rear of the structure shown in FIG. 2.

The clamping fixture 10 (as shown singly in FIG. 8) comprises a relatively thin elongated plate-like back support member 16 having a concave cylindrical bearing surface 18 of more than semicircular compass but interrupted by a gap 20 extending throughout the length of the back support member 16 on the top edge thereof. The back support member 16 is also provided with protruding hanging brackets 22, shown in FIG. 8, which are punched or otherwise formed on one face of the back support and of a length to engage suitable slots 24 (FIGS. 3 and 5) provided in the top edge of the support board 12. This back support member 16 is also provided with a plurality of protruding studs 26 corresponding in number to the number of holes 28 (FIG. 7) formed in a typical paper pad, such holes 28 being predrilled and symmetrically spaced in the paper pad.

Figure 5:
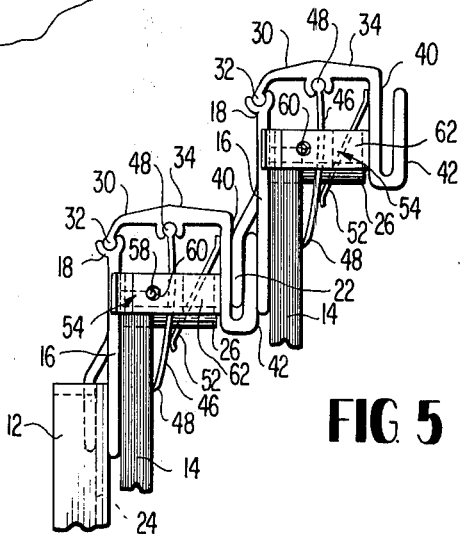
FIG. 5 shows a ganged arrangement of a plurality of fixtures constructed in accordance with the teachings of this invention.

Clamping fixture 10 also is provided with a clamp housing 30 in the form of a channel, also preferably formed of an extruded metal and having on one edge an integrally formed rod-like member 32 which forms a pivot joint when inserted in the cylindrical bearing surface 20 of the support member. Spaced from the rod-like pivot is a top or cross wall 34 containing an additional concave cylindrical bearing surface 36 with gap 38 which faces the channel space formed by the clamp housing and is also provided with a front wall 40 which also acts as a stop point for the protruding studs 26. An upwardly directed spur 42 continues in parallel but spaced from the front wall 40 and acts as a support retainer for protruding brackets 22 when a complete clamping fixture is ganged with other clamping fixtures such as shown in FIG. 5.

Within the channel space and pivoting within the bearing surface 36 located in the cross wall 34, is a relatively long thin preferably extruded metal tear member 46 having at its upper end a rod-like part 48 which is located within bearing surface 36 to form a hinge joint. The hinge gap 38 of bearing surface 36 is so arranged as to limit the blade's traverse movement, thereby keeping the blade from interfering with the paper pad installation and removal when the clamp housing is in open position, and the lower edge 48 of the tear member is beveled to produce sharpness and intensity of contact pressure. Also, along the blade's lower paper edge are slots 50 (FIG. 7) corresponding to the number of protruding studs 26 and located so as to allow the blade member to pivot past the studs and to come into contact with the paper pad or stack of sheets 14.

Figure 4:
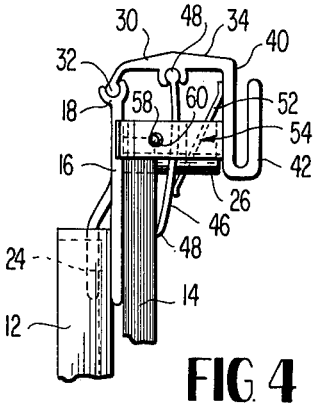
FIG. 4 is an end elevation.

Tear blade member 46 is held in spring tension by a leaf spring 52 (FIGS. 4 and 5) suitably attached either to the blade's front surface, allowing it to press against the clamp housing as shown, or fastened to the clamp housing thereby pressing against the blade member. The spring tension is sufficient to clamp single sheets or pads of sheets when they are placed within the clamp fixture and to act as a tear blade when the full pads are in position.

At each of the outer ends of the clamping fixture 10 there is provided a snap lock arrangement, indicated at its entirety as 54, which facilitates the opening and closing of the clamping fixture 10 for ready insertion and removal of the sheets or pads of paper. The snap lock arrangement 54 comprises an L-shaped bracket 56 suitably attached near the outer edges of the back support member 16 and provided with a relatively small protruding stud 58 (clearly shown in FIG. 7) engageable in a suitable aperture 60 in an L-shaped spring lock member 62 which is suitably attached to the inner edge of the outer wall 40 of the clamp housing. The spring lock member 62 is provided with a spur or bent portion 64 which serves as a means for grasping and bending the lock to disengage the protruding studs from the apertures to open the lock.

To place paper pads in position within the clamp housing, it is simply necessary to unlock the ends of the clamp housing lock arrangement 54 by grasping the bent portion 64 and overcoming the tension of the spring to disengage pin 58 and pivoting the clamp housing and tear blade as a unit about the pivot hinge approximately 90° on the back support member 16. It is to be noted that the hinge joint on the back support member remains stationary while the blade member and clamp housing swings to fully open the housing. At this time, a pad of paper may be inserted on the protruding studs 26 and the clamping housing and tear blade member can then return to its closed position by pivoting about the stationary hinge joint. The closing of the housing is automatic and snap locked by the snap lock arrangement 54 and the clamping of the pad or sheet by the tear blade member 46 is also automatic by reason of the tension springs 52. It is to be noted also that with the closing, the inside face of the front wall 40 engages the ends of the hanging studs 26 thereby locking the paper or paper sheets against inadvertent removal.

From the foregoing it can be seen that with the clamp housing and tear blade moving as a unit, the opening and closing of the clamping fixture 10 can be done quickly and effortlessly in closed position because the tension is applied to the pad automatically through the spring-actuated tear member and the closing is automatic by the spring action of the locks.

Finally, attention is now directed to FIG. 9 where an alternative form of snap lock arrangement is shown. In this embodiment the snap lock arrangement **54*a* of suitable plastic material comprises a resilient L-shaped portion 56*a* which is attached to the outer wall 40 and formed integral with a spring lock arm 62*a*. At the opposite end of the spring lock arm 62*a* there is provided a hook surface 70 and an integral spur 64*a* which serves as a handle. The hook surface 70 engages the back support member 16 when in locked condition and is released by pulling on the spur 64*a*.**

Thus, to open the clamp housing it is simply necessary to pull on the spur to bend the spring lock arm **62*a* away from the back support member and to close the clamp housing, it is simply necessary to pivot the housing toward the back support member where initial engagement of the edge of the back support member against a camming surface 72** will overcome the resiliency of the spring lock arm until the camming surface is past the edge of the back support member whereby the hook surface will again engage to lock the clamp housing.

I claim:

1. A clamping fixture for hanging and clamping a heavy stack of large sheets of paper against the front surface of an upright support board in condition to be torn off one-by-one comprising:

a back support member adapted to be supported on the top edge of said upright support board;

a clamping member pivotally attached to said support member;

a tear blade member pivotally attached to said clamping member and adapted to swing with said clamping member when the latter is swung about its pivotal attachment to open said clamping fixture for the insertion of paper therein, said tear blade member engaging the paper and clamping the same against the front surface of the upright support board when the clamping member and tear blade are again swung in a closed position; and resilient tensioning means between said clamping member and said tear blade member resiliently urging the tear blade member against the paper when said fixture is in closed position and wherein said pivotal attachment of said tear blade and member to said clamping member together with said resilient tensioning means automatically adjusts to accommodate sheets or pads of paper of different thicknesses.

2. The clamping fixture as claimed in claim 1 wherein means are provided for snap locking the clamping fixture in closed position.

3. The clamping fixture as claimed in claim 2 further including studs fastened to the back support member for holding the paper on pre-drilled holes, and a wall on said clamping member, said wall engaging said studs when said clamping fixture is in closed position to lock and prevent removal of said paper from said pre-drilled holes when said clamping fixture is locked closed.

4. A clamping fixture for hanging and clamping a heavy stack of large sheets of paper against the front surface of an upright support board in condition to be torn off one-by-one comprising:

a back support member adapted to be supported on the top edge of said support board, said member including a portion of a stationary hinge joint;

a clamping member including a portion of a stationary hinge joint and adapted to be pivotally attached to said support member;

said clamping member further having a portion of a movable hinge joint;

a tear blade including a portion of said movable hinge joint and adapted to be pivotally attached to said clamping member to swing about said stationary hinge joint to a clamping fixture open portion for insertion of paper in said clamping fixture; and tensioning means for resiliently urging said tear blade member against the paper when said fixture is in a closed position.

5. The clamping fixture as claimed in claim 4 wherein said back support member is provided with means for attaching said support member to the top edge of said support board.

6. The clamping fixture as claimed in claim 4 wherein said clamping member includes means for allowing like clamping fixtures to be ganged one on the face of another thereby allowing multiple pads of paper to be displayed on a single upright support board.

7. The clamping fixture as claimed in claim 4 wherein means are provided for snap locking said clamping member to said back support member when said fixture is in a closed position.

8. The clamping fixture as claimed in claim 4 wherein said snap locking means comprises means on said back support member supporting a detent pin, spring means on said clamping member with an aperture to receive said pin, said spring means being yieldable to remove said aperture from said pin permitting opening of said snap lock means.

9. The clamping fixture as claimed in claim 7 wherein said snap locking means comprises a resilient arm attached to said clamping member and engageable with said back support member.

10. A clamping fixture for hanging and clamping a heavy stack of large sheets of paper against the front surface of an upright support board in condition to be torn off one-by-one comprising:

a relatively flat relatively long back support member adapted to be supported horizontally on the top edge of said support board, said member including a front portion of a stationary hinge joint;

a relatively long channel-shaped clamping member having a pair of side walls separated by a cross wall;

said clamping member including a portion of said stationary hinge joint on one of said side walls and when joined to said front portion pivotally attaches said clamping member to said support member;

said clamping member further having a portion of a movable hinge joint located on said cross wall;

a tear blade including a portion of said movable hinge joint and adapted to be pivotally attached to the cross wall of said clamping member to swing about said stationary hinge joint to a clamping fixture open portion for insertion of paper in said clamping fixture; and resilient tensioning means for resiliently urging said tear blade member against the paper when said fixture is in a closed position.

* * * * *